US007682410B2

(12) United States Patent
Mueller et al.

(10) Patent No.: US 7,682,410 B2
(45) Date of Patent: Mar. 23, 2010

(54) GAS ODORANT

(75) Inventors: Urs Mueller, Duebendorf (CH); John Norman Short, L'Isle Adam (FR)

(73) Assignee: Givaudan SA, Vernier (CH)

( * ) Notice: Subject to any disclaimer, the term of this patent is extended or adjusted under 35 U.S.C. 154(b) by 148 days.

(21) Appl. No.: 11/718,694

(22) PCT Filed: Nov. 8, 2005

(86) PCT No.: PCT/CH2005/000654

§ 371 (c)(1),
(2), (4) Date: Oct. 16, 2007

(87) PCT Pub. No.: WO2006/050629

PCT Pub. Date: May 18, 2006

(65) Prior Publication Data

US 2008/0256847 A1 Oct. 23, 2008

(30) Foreign Application Priority Data

Nov. 9, 2004 (EP) ..... 04300770
Mar. 20, 2005 (EP) ..... 05290463

(51) Int. Cl.
*C10L 1/18* (2006.01)
*C10L 1/22* (2006.01)

(52) U.S. Cl. ..... 44/335; 44/451

(58) Field of Classification Search ..... 44/335, 44/451

See application file for complete search history.

(56) References Cited

U.S. PATENT DOCUMENTS 3,627,540 A 12/1971 Katz et al.
7,108,803 B1 9/2006 Mansfeld et al.

FOREIGN PATENT DOCUMENTS

DE 19837066 A1 2/2000
JP 55104393 A 8/1980
WO 2006050629 A1 5/2006

OTHER PUBLICATIONS 1-methoxy-1-butene-3-yne http://www.chemicalbook.com/ChemicalProductProperty_EN_CB4407760.htm 2007.*
Bianchini, C, Stoichiometric and catalytic functionalization reactions of alkynes, Pure & Appl. Chem., vol. 63, No. 6, pp. 829-834, 1991.*
International Search Report in connection with International application No. PCT/CH2005/000654, dated Mar. 6, 2006.
Written Opinion of the International Searching Authority in connection with International application No. PCT/CH2005/000654, Mar. 2006.
Sensory Reactions of Nasal Pungency and Odor to Volatile Organic Compounds: The Alkylbenzenes, Cometto-Muniz JE et al., American Industrial Hygiene Association Journal, V. 55, No. 9, 811-17, Sep. 1994, XP002370695.
Sulfur-Free Odorant for Natural Gas Results of a Fleld Test, Reimert, R. et al., Engler-Bunte-Institute of the University Karlsruhe, Germany.

* cited by examiner

*Primary Examiner*—Cephia D Toomer
(74) *Attorney, Agent, or Firm*—Norris McLaughlin & Marcus, PA

(57) ABSTRACT

The present invention refers to the use as gas odorant of alkoxy alkynes of formula (I)

(I)

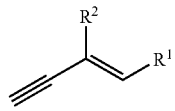

wherein $R^1$ is methoxy or ethoxy; and $R^2$ is hydrogen or methyl, to a process of odorizing gas and to fuel gas comprising it.

7 Claims, No Drawings

GAS ODORANT

This is an application filed under 35 USC 371 of PCT/CH2005/000654.

The present invention relates to the use of alkoxy alkynes as gas odorants, to a process of odorising gas and to fuel gas comprising them.

Because of their origin and their relative high degree of purity, fuel gases are substantially odorless. If leakages are not noticed in good time, explosive mixtures with a high hazard potential may be quickly formed. For safety reasons, gas is therefore odorized by adding odorants. For example, tetrahydrothiophene (THT) is used throughout the European Union area as a city gas odorant, usually as the sole odorant. In North America, tertiary butyl mercaptan is widely used as the principal odorant, often in association with other alkyl mercaptans and various sulphides and disulphides. For liquid petroleum gas, for example, ethyl mercaptan is used as an odorant. These compounds are particularly well suited for use as gas odorants because of their very powerful, unpleasant and distinctive odours. Furthermore, because they have been used for a very long time they, are nowadays universally associated with combustible gases and thus meet the requirement for a distinct and well recognized warning of a gas leakage. However, with regard to environmental aspects, sulfur compounds are less suitable because sulfur dioxide is formed during the combustion of such odorized gases. Furthermore, sulfur-based compounds are known to poison electrode catalysts of fuel cells when converted into $H_2S$, which results in severe degradation of the performance of the fuel cell.

To be highly suitable as gas odorant, a compound or a mixture of compounds, i.e. a composition, has to fulfill a number of requirements. In particular, to avoid the danger of confusion, the odour of the gas odorant needs to:

- be distinctive enough that there is very little risk that it will be identified as any other smell. Ideally it should be immediately associated with the odour of current gas odorants, because their broad use make the odour of gas easily recognizable to the majority of users.
- have a detection threshold several orders of magnitude lower than the explosive limit of the fuel gas in order that everybody with an average sense of smell and average physiological conditions is able to detect the odor.

Furthermore, the gas odorant has to be stable under the storage and transport conditions of the fuel gas.

Several attempts have been made to replace or at least reduce the use of sulfur compounds as odorant in fuel gas. For example, DE-A 19837066 describes the use of a mixture of acrylic alkyl esters and nitrogen compounds. A fuel gas odorant comprising an alkyne such as but-1-yne, vinylacetylene and hexyne, and at least two compounds selected from methyl acrylate, ethyl acrylate, methyl methacrylate, allyl methacrylate, ethyl propionate, methyl n-butyrate, and methyl isobutyrate is disclosed in JP-A-55-104393 (abstract). The problem with acrylic alkyl esters is that their odor notes are very similar to, for example, certain acrylic plastics and paints.

Accordingly, there is an ongoing demand to find alternative odorants, which are suitable as gas odorants. Surprisingly, it has been found that certain alkynes are particularly suitable as odorants for fuel gas.

Accordingly the present invention refers in one of its aspects to the use as fuel gas odorant of alkoxy alkynes of formula (I)

(I)

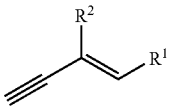

wherein $R^1$ is methoxy or ethoxy; and $R^2$ is hydrogen or methyl.

Particularly preferred as a fuel gas odorant is 1-methoxy-buten-3-yne.

The term "gas odorant" as used within the meaning of this invention may refer to both a single odorous compound and a mixture of such odorous compounds.

Fuel gases are in general used for generating electrical power by combustion in power stations, or used in buildings for heating, illuminating and cooking processes. They can also be used to generate hydrogen gas for use in hydrogen fuel cells by a process commonly known as "reforming". The term "fuel gas" as used within the meaning of this application stands for any combustible hydrogen or hydrocarbon gas used as a primary or secondary energy source. They are in gaseous form at normal atmospheric temperature and pressure (25° C.; 1000 mbar) but may also be processed in their liquid form for convenience of transport and storage. Fuel gases encompass, but are not limited to, the terms: city or town gas, natural gas including its liquefied form, liquid petroleum gas (LPG, which is a mixture of alkanes separated from petrol and consisting essentially of butane and propane), and hydrogen gas. Alkynes, such as acetylene, are also suitable as fuel gas. Oxygenated hydrocarbons, such as dimethyl ether, that can be used as a source of energy by combustion or to generate hydrogen for fuel cells, also belong to the class of fuel gases within the meaning of this application.

The compounds of the present invention may be used alone or in combination with known gas odorants, i.e. with sulfur compounds and sulfur-free compounds. Particularly preferred is the combination with sulfur-free gas odorants, for example pyrazines, preferably in an amount of up to 10 parts per weight, more preferably up to 5.5 parts by weight, e.g. 0.1 to 5.5 parts by weight per 100 parts by weight of an alkoxy alkyne of formula (I) or a mixture thereof. If combined with sulfur compounds the fuel gas odorant preferably comprises up to 60 weight %, more preferably 1 to 30 weight %, for example 1 to 10 weight %, of a sulfur compound or a mixture thereof, based on the total amount of gas odorant.

Suitable pyrazines include but are not limited to methyl ethyl pyrazine, methoxy isobutyl pyrazine, and methoxy methylpyrazine. Further suitable pyrazines are disclosed in JP-A-08-60167, which is incorporated by reference. By admixing the compounds of the present invention together with a smaller amount of pyrazine even better results can be achieved.

Suitable sulfur compounds include but are not limited to compounds selected from the group consisting of $C_1$-$C_4$ alkyl mercaptane, e.g., tert.-butyl mercaptan and ethyl mercaptan, aryl mercaptanes, e.g. benzyl mercaptan, organic sulfides and disulfides, e.g. dimethyl sulfide and ethyl methyl sulfide, and tetrahydrothiophene and their derivatives.

Accordingly, particularly preferred are gas odorants comprising:

a) at least one alkoxy alkyne of formula (I); and b) at least one pyrazine compound, wherein the pyrazine is preferably selected from the group consisting of methyl ethyl pyrazine, methoxy isobutyl pyrazine and methoxy methylpyrazine; and/or c) at least one sulfur compound.

In particular embodiments are gas odorants comprising at least one alkoxy alkyne of formula (I) and at least one sulfur compound.

Other excipients such as antioxidants may also be added, either to the odorant or directly to the odorized fuel gas. Suitable antioxidants include but are not limited to tert. butylhydroxyanisole, 2,5-di-tert-butyl-phenol (lonol), hydroquinone monomethyl ether and α-tocopherol, 2,6-di-tert-butyl para cresol and tert-butyl hydroxy toluene.

A further aspect of the present invention is a fuel gas comprising a gas odorant comprising a) at least one alkoxy alkyne of formula (I);

b) and optionally at least one pyrazine compound, wherein the pyrazine is preferably selected from the group consisting of methyl ethyl pyrazine, methoxy isobutyl pyrazine and methoxy methylpyrazine;

c) and optionally at least one sulfur compound.

In particular embodiments are fuel gas comprising a gas odorant comprising at least one alkoxy alkyne of formula (I) and at least one sulfur compound.

The dosage of the gas odorant of the present invention in the fuel gas mainly depends on the composition of the odorant and may vary from 1 to about 100 ppm, preferably between 5 and 50 ppm, more preferably between 20 and 40 ppm.

Furthermore the present invention refers to a method of odorizing fuel gas comprising the incorporation as odorant of an effective amount of at least one alkoxy alkyne as hereinabove described.

The fuel gas odorants of the present invention are liquids at room temperature and thus, both the preparation of an odorant composition if required and the admixing of the odorant/odorant composition to the fuel gas is not critical. The methods and equipments known to the person skilled in the art may be used.

The invention is now further described with reference to the following non-limiting examples.

EXAMPLE 1

Gas Odorant Compositions

Table 1 shows preferred gas odorants of the present invention and known gas odorants (1 to 5), which were prepared as a reference.

The following abbreviations are used in Table 1:

MET: 1-Methoxy-buten-3-yne

MEP: methyl ethyl pyrazine

THT: tetrahydrothiophene

TBM: tert.-butyl mercaptan

DMS: dimethylsulphide

EAC: ethyl acrylate

MAC: methyl acrylate

TABLE 1

| | odorous compounds | | |
|---|---|---|---|
| odorant | MET | MEP | other compounds |
| A | 100 | | |
| B | 95 | 5 | |
| C | 80 | | 20 (TBM) |
| D | 80 | | 14 (DMS), 6 (TBM) |
| 1 | | | 100 (THT) |
| 2* | | 2.5 | 60 (EAC), 37.5 (MAC) |
| 3** | | | Labogaz 206 |
| 4*** | | | 70 (DMS), 30 TBM |
| 5 | | | 100 (TBM) |
| | | | % by weight |

*Gasodor S-FREE ® as disclosed in Gas und Wasserfach, Gas, Erdgas 142/11 732, 779-780, 782-784 (November 2001)

**commercial propane/butane gas with a mixture of sulphur compounds as gas odorant. Sold in France as Campingaz ™.

***Mixture of gas odorant used for LPG in France.

EXAMPLE 2

Comparison Study to Known Gas Odorants

Isobutane gas aerosols comprising the odorants A, B, 1, 2 or 3 (Example 1, Table 1) at a dosage of 40 ppm were prepared. The aerosol was sprayed into a booth of 7 $m^3$ and sniffed through a small port in the door of the booth by a panel of 30 individuals, who are familiar with the smell of gas. They had been asked to evaluate the smell, having the smell of gas in mind, on a 4 point scale (4=totally agree (i.e. equal to the odour of gas), 3=mostly agree, 2=mostly disagree, and 1=totally disagree). The odorants were tested blind and the panelists were not aware of the composition. The average-results are listed in Table 2.

TABLE 2

| odorant | Similarity |
|---|---|
| A | 2.33 |
| B | 2.40 |
| C | 3.24 |
| D | 3.00 |
| 1 | 3.88 |
| 2 | 1.84 |
| 3 | 3.90 |

The invention claimed is:

1. A fuel gas odorant comprising a) an alkoxy alkyne of formula (I)

(I)

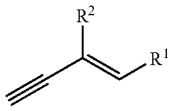

wherein $R^1$ is methoxy or ethoxy; and $R^2$ is hydrogen or methyl; and b) at least one sulfur or pyrazine compound.

2. A fuel gas odorant according to claim 1, wherein the pyrazine is selected from the group consisting of methyl ethyl pyrazine, methoxy isobutyl pyrazine and methoxy methyl pyrazine.

3. A fuel gas comprising a gas odorant of formula (I)

(I)

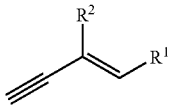

wherein $R^1$ is methoxy or ethoxy; and $R^2$ is hydrogen or methyl.

4. A method of odorizing fuel gas comprising the incorporation as odorant of an effective amount of at least one alkoxy alkyne of formula (I)

(I)

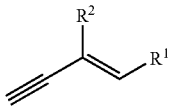

wherein $R^1$ is methoxy or ethoxy; and $R^2$ s hydrogen or methyl;

to the fuel gas.

5. A method of odorizing fuel gas according to claim 4 comprising the incorporation as odorant of an effective amount of 1-methoxy-buten-3-yne to the fuel gas.

6. A fuel gas comprising a gas odorant according to claim 1.

7. A fuel gas comprising a gas odorant according to claim 2.

* * * * *